United States Patent [19]

Dassler

[11] Patent Number: 4,507,879

[45] Date of Patent: Apr. 2, 1985

[54] ATHLETIC SHOE SOLE, PARTICULARLY A SOCCER SHOE, WITH A SPRINGY-ELASTIC SOLE

[75] Inventor: Armin Dassler, Herzogenaurach, Fed. Rep. of Germany

[73] Assignee: PUMA-Sportschuhfabriken Rudolk Dassler KG, Fed. Rep. of Germany

[21] Appl. No.: 467,289

[22] Filed: Feb. 17, 1983

[30] Foreign Application Priority Data

Feb. 22, 1982 [DE] Fed. Rep. of Germany ..... 3206305

[51] Int. Cl.[3] ..... A43B 13/18; A43B 5/00

[52] U.S. Cl. ..... 36/102; 36/114; 36/129; 36/28; 36/59 C

[58] Field of Search ..... 36/102, 126, 128, 129, 36/31, 32 R, 59 R, 59 A, 59 C, 29, 28, 25 R, 114, 7.3; D2/309, 320

[56] References Cited

U.S. PATENT DOCUMENTS

| | | | |
|---|---|---|---|
| 3,029,529 | 4/1962 | Schwartz | 36/126 |
| 4,319,412 | 3/1982 | Muller et al. | 36/29 |

FOREIGN PATENT DOCUMENTS

| | | | |
|---|---|---|---|
| 809143 | 7/1951 | Fed. Rep. of Germany | 36/128 |
| 231562 | 8/1966 | Fed. Rep. of Germany . | |
| 553710 | 5/1969 | Fed. Rep. of Germany . | |
| 7006079 | 5/1970 | Fed. Rep. of Germany . | |
| 2022974 | 11/1971 | Fed. Rep. of Germany . | |
| 2847152 | 5/1980 | Fed. Rep. of Germany | 36/128 |
| 2459623 | 2/1981 | France | 36/32 R |

*Primary Examiner*—Werner H. Schroeder
*Assistant Examiner*—Steven N. Meyers
*Attorney, Agent, or Firm*—Sixbey, Friedman & Leedom

[57] ABSTRACT

An athletic shoe, particularly a soccer shoe, with extreme flexibility in the ball area and, preferably, in the mid-foot joint area as well, is achieved by the provision or ribs in these areas on the contact side of the sole as well as on the insole side. The ribs form a continuous undulating band consisting of wave crests and valleys, and may be formed as a unitary part of the sole or may be a separate component made integral with the sole during manufacture thereof, such as by the sole material being injected or case around them.

25 Claims, 10 Drawing Figures

ATHLETIC SHOE SOLE, PARTICULARLY A SOCCER SHOE, WITH A SPRINGY-ELASTIC SOLE

BACKGROUND AND SUMMARY OF THE INVENTION

The invention concerns an athletic shoe, particularly a soccer shoe, of the type having a springy-elastic sole made of plastic, to which studs, claws or spikes are attached, preferably in an easily replaceable manner.

There have been many attempts to increase the flexibility of athletic shoe soles in the area of the ball and/or in the joint area. Thus, for example, the athletic shoe sole according to DE-GM No. 19 43 819 was provided with a flexible area which was located exclusively in the ball section and faced toward the inside of the shoe, while two parallel ribs and depressions in the sole between them ran transversely across the sole longitudinal axis. On the other hand, the ground contacting side of the sole was made level, even in the flexible area, so that this reduction in sole strength on one side ensured only a limited increase in flexibility of the sole within the flexible area. In athletic shoe soles made of springy-elastic plastic such as a polyamide, polyurethane, etc., sufficient sole flexibility cannot be achieved by the above-mentioned measure, because this type of sole material is not sufficiently elastic. In addition, the flexibility of this known athletic shoe sole is limited by the fact that it is also provided with relatively wide edge strips which have no reductions in material on either side and because, when the sole is bent, the rib edges shift into an oblique position, so that they are, in practice, subjected to bending stress and, as a result, cannot absorb the athlete's weight at the instant when he feels that he has found the firm position he was seeking.

From the DE-GM No. 19 73 891, a way is known of reducing sole strength on the contact side, in order to achieve a certain flexibility of the sole. In this design, a local reduction in the strength of the central part of the sole or in the joint area is achieved by using approximately elliptical recesses or impressions in the front part of the sole and grooves running transversely across the longitudinal axis of the sole in the joint area, the walls of which are relatively thick. Thus, when ribs are also left between the adjacent grooves or recesses, these soles are hardly suitable for practical use because of the thick-walled sole in the joint area and the resulting high weight of the shoe, as well as because of the increased risk of fracture in the joint section which is endangered by notch-shaped incisions. This is compounded by the lack of reduction in thickness in the sole edge areas, which counteract its flexibility.

These disadvantages also exist in athletic shoe soles according to DE-OS No. 20 22 974 and DE-GM No. 70 06 079. In addition, especially the transverse grooves which are part of this design become collecting spots for pebbles and other foreign objects, such as dirt particles, which prevent the relatively thick sole components from returning easily to their original position. This too is quite annoying and considerably reduces the athlete's performance.

Thus, a principal object of this invention is to develop an athletic shoe, particularly a soccer shoe of the type mentioned at the beginning, in such a way that, at least in the ball area between the fittings, a flexible area of maximum flexibility is created. The joint area connected to the front part of the sole should also be easy to bend when a gradation is executed to obtain greater flexibility in the ball area than in the adjacent front joint area.

This object is achieved in accordance with preferred embodiments of the present invention by the provision of at least one flexible area on both the insole and exposed sides of the sole having ribs formed as a continuous undulating band of wave crests and valleys.

The invention achieves, in particular, the advantage that extreme bending of the front part of the sole in the ball area and preferably also in the front joint area can occur without hindering the natural roll-away process of the foot in these sole areas and can occur uniformly over the whole width of the sole. The flexing area or areas, which are designed as an undulating band, are extremely flexible because the undulating band provides a reserve of material which makes expansion possible, i.e., it allows actual stretching or elongation of the sole in the longitudinal direction of the sole or in the direction of its radius of curvature, even if springy-elastic plastics, which by nature are non-stretchable, are used. Thus, the bending force needed for bending will be reduced to a minimum and the compressive effect on the insole will be completely or very largely avoided. The undulation of the band can be adjusted such that the gain in length resulting from stretching is so great that compression of the adjoining insole does not occur at all. Basically, the insole in the flexible area or areas can also include intermediate pieces made of a volume-compressible material to absorb enough of the remaining compressive forces that the bending process of the insole is not counteracted by unwanted additional resistance.

Due to the extraordinary flexibility of the sole in the flexible area or areas, another advantage will also be obtained, consisting in the fact that, in the bending process, all of the studs, claws or spikes in the front sole area will remain attached to the ground for a relatively long period and will then be extracted from the ground fairly quickly and virtually perpendicularly, i.e., without any nominal effort, so that damage to race tracks and turf (caused mainly by the rear studs, claws or spikes in the front sole area) will be avoided and the effort required for the break-away moment will be drastically reduced.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
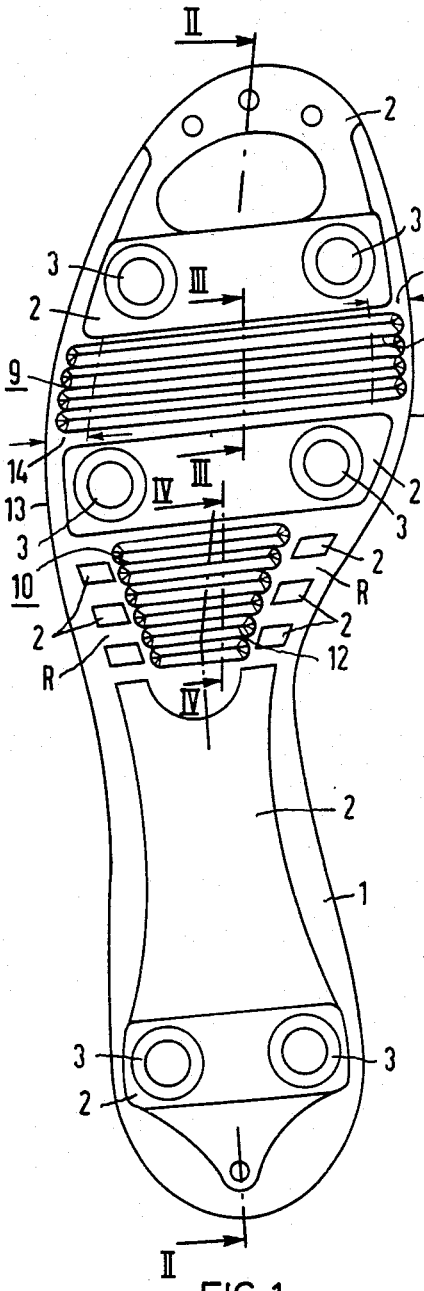
FIG. 1 is a top view of the contact side of an athletic shoe with an athletic shoe sole designed according to a preferred embodiment of the invention.

FIGS. 4 to 10 show the undulating band on a greatly enlarged scale, and throughout the figures like reference numerals are used to designate features common to the various embodiments.

Figure 2:
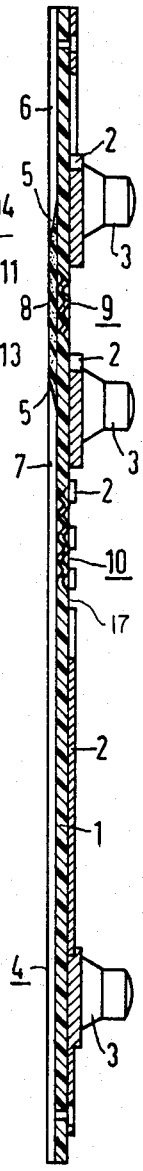
FIG. 2 is a longitudinal section of the sole according to FIG. 1, taken along section Line II—II thereof.
Figure 3:
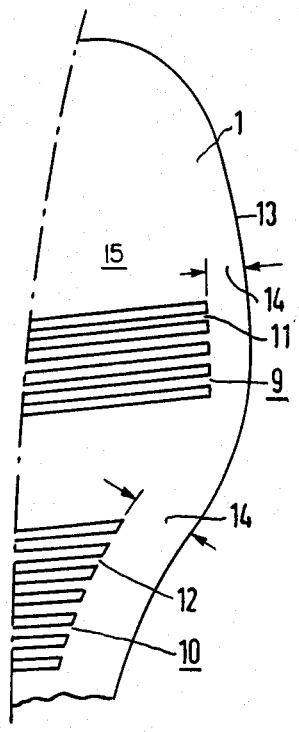
FIG. 3 is a schematic top view of a part of the side of the sole facing toward the inside of the shoe.

In FIGS. 1 to 3, 1 indicates a sole of an athletic shoe, particularly a shoe for use in playing soccer, football and the like, while 2 indicates areas of strengthened material for studs 3. When this shoe is to be used for racing or baseball, spike or claw type fittings of appropriate shapes are mounted in these areas instead of the stud-type cleats shown. An insole 4 covers sole 1 on inside 15 of the shoe. Since the insole 4 includes an insole board and such boards are typically made of cellulose fibers, the insole 4 of the present invention provides an elastic, intermediate piece 8 between the conventional insole components 6 and 7. Each of the components 6, 7 is provided with a chamfered impact surface which is connected on a corresponding side of the flexible zone of undulating band 9 to the elastic intermediate piece 8. The intermediate piece 8 is made, preferably, of volume-compressible material, such as a rubber, preferably foam or porous rubber, which has the property of being elastically expansible or compressible under tensile or pressure loads. Additionally, the intermediate piece 8 is preferably trapezoidal in shape, and rests with the long side of the trapezoid on the double-rib-shaped undulating band 9 or in the region of the flexible area of the central part of the sole front. The elasticity of intermediate piece 8 ensures that, even under extreme bending of the sole 7 and in case of a not quite sufficient "degree of undulation", resulting in an insufficient expansion reserve, the formation of beads in the insole, which is otherwise possible and problematical, is avoided. Such an intermediate piece can basically also be used in other flexible areas, such as in the area of undulating band 10, to reliably prevent any bead formation in the insole as well.

Ribs 11 of undulating band 9 extend, heightwise, close to sole surface 17, and, although ribs 11 extend lengthwise to the immediate proximity of the sole edges 13 at surface 17 (FIG. 1), they end, on inside 15 of the sole, at a distance 14 (approximately 10 mm) from the sole edges (compare FIGS. 1 and 2). In this way, on the one hand, a sufficiently large attachment or gluing strip is provided for the attachment of the sole 7 to the upper part of the athletic shoe. On the other hand, because on the contact side of the sole 7, ribs 11 extend across or almost across the whole sole width, any strengthening of the material which would otherwise result and which would adversely affect the sole flexibility and the total weight of the shoe is avoidable. Furthermore, if, as shown in FIG. 1, the ribs 11, 12 do not extend the full width of the sole, then the ends thereof should, preferably, be rounded-off at least on the outer side 17.

In the midtarsal (mid-foot) joint area, particularly in the front joint section, there are also ribs 12 which, however, are bordered on both sides by a rib-free edge R, which is, preferably, also about 10 mm wide. In these edge strips R, rectangular or trapezoidal sole components 2 of especially hard, abrasion-resistant material can be provided, as is done for the other strengthened components 2 in the ball and the heel areas. Because of the remaining strips R, the flexibility of sole 1 in the front joint area is somewhat less than in the ball area; this is not particularly problematical because a wavy sole component, even with the remaining edge strips R, is considerably more flexible than a sole component the strength of which is reduced merely by recesses on just one side, as is done in the known soles cited at the beginning. Basically, there is also the option of making the undulating band 10 wider, especially in the intermediate areas between the sole components, i.e., to extend the undulating band 10 all the way to or almost all the way to the existing sole edge.

FIGS. 4 to 10 show various practical examples of the design of undulating bands 9 or 10.

Figure 4:
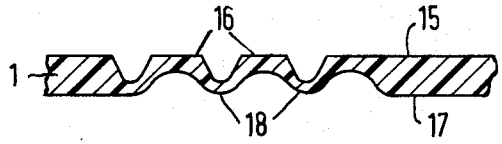
FIG. 4 is a cross section of a flexible area or undulating band as seen along either of Section Lines III—III and IV—IV in FIG. 1, wherein the sole on the inside of the shoe is equipped with approximately trapezoidal ribs and on the contact side with wavy ribs in the form of an undulating band.

In FIG. 4, the inner side 15 of sole 1 is equipped with trapezoidal ribs 16 and the outer side 17 with wavy ribs 18.

Figure 5:
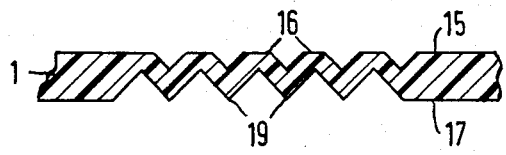
FIG. 5 is a cross section, similar to that of FIG. 4, of an undulating band with saw-tooth-shaped ribs on the contact side.

In FIG. 5, sole inner side 15 is again provided with trapezoidal ribs 16, while V-shaped ribs 19 are provided on the outer side of sole 17.

Figure 6:
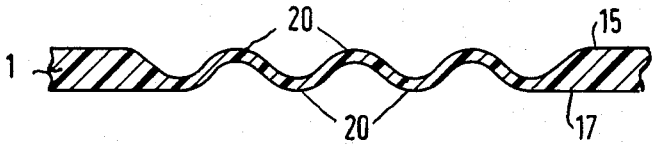
FIG. 6 is a cross section, similar to that of FIG. 4, of an undulating band with wavy ribs on both sides.

FIG. 6 shows the flexible area or undulating band 9 or 10 with a double-wave profile which, on the inside of sole 15, features waves 20 and, on the sole outer side 17, two waves 20 of the identical shape.

Figure 7:
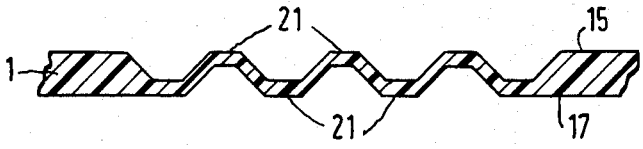
FIG. 7 is a cross section, similar to that of FIG. 4, of an undulating band with approximately trapezoidal ribs on both sides.

FIG. 7 shows a double-rib profile with approximately trapezoidal ribs 21 on both sides.

Figure 8:
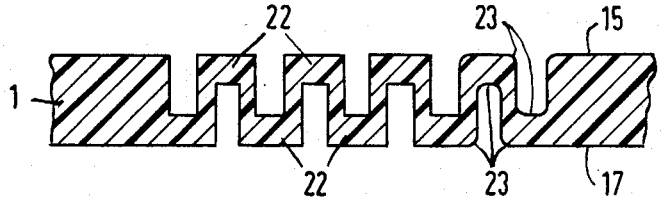
FIG. 8 is a cross section, similar to that of FIG. 4, of an undulating band with step-like meandering ribs on both sides.

FIG. 8 shows U-shaped ribs 22 which are arranged in a step-like meandering pattern. In this case, the outer and inner edges can be rounded off as indicated at 23.

Figure 9:
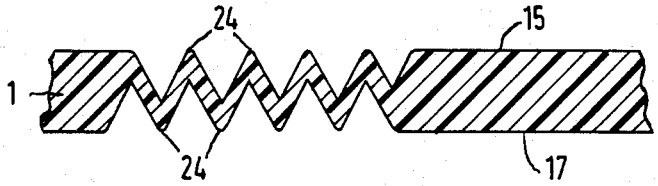
FIG. 9 is a cross section, similar to that of FIG. 4, of a bellows-shaped undulating band with V-shaped ribs on both sides.

FIG. 9 shows a saw-tooth design for the flexible areas of wavy ribs 9 or 10, in which ribs 24, on both the outer sole and insole sides, are V-shaped.

Figure 10:
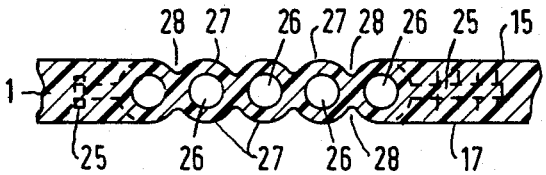
FIG. 10 is a cross section, similar to that of FIG. 4, of an undulating band in the form of small parallel matching tubes extending over at least almost the whole width of the sole and enveloped by the material of which the sole is made.

FIG. 10 shows a practical example in which the wave profile part is manufactured as a separate component and, in the process of the manufacture of the sole, is enveloped by the sole material which is either injected or cast around it. Rib-shaped anchoring components are designated as 25. Basically, these anchoring components 25 can also be omitted because the ends of the wavy profile section which are adjacent to the sole components on both sides can be, for example, glued to them. Moreover, it is possible to manufacture undulating bands, shown in FIGS. 4 to 9, as separate profile components. An especially simple and durable design is obtained when small plastic bars or tubes 26 are enveloped by injected or cast material such that, on the insole side as well as on the contact surface side of the sole, wavy ribs 27 with alternating valleys result.

The dimensions of the wave crests and valleys are set such that, in the ball area between the front and rear fittings, preferably, three wave crests and four wave valleys are created, while, in the front joint area beyond the rear fittings of the front sole, preferably, five wave crests and six wave valleys are formed. If undulating bands of prefabricated individual components are used, the flexibility can be adjusted quite accurately by proper selection of material. However, even in the case of soles with integrated undulating bands, such adjustment can be carried out because they are shaped differently in the ball and joint areas. It seems to be particularly advantageous to increase the flexibility of the undulating band in the ball area by more distinct and specific molding in the ball area than in that of the joint, a consideration to which reference was made at the beginning.

The present invention is not limited to the specific embodiments presented and described here; it can be expanded in many ways. Thus, for example, the various rib profiles can be freely combined, and either the same patterns on both sides can be used or there can be a different profile on the inside of sole 15 from that on the outside 17.

In addition to the plastics already widely used for soccer shoes, such as polyamide (nylon) or polymethane, all materials commonly used in the athletic shoe industry, preferably springy-elastic ones, can be considered for use as sole materials as long as they fulfill the requirements of the competition in which they are to be used.

The invention is not limited to team sports, such as soccer, football, baseball, etc. It provides the same or similar advantages for individual sports, particularly in various running or jumping events.

The fittings do not necessarily have to be attached to the sole in such a way that they can be easily replaced. They may be designed as an integral part of the sole, as in the case of the so-called nubbed sole shoes, or they can be made of a harder material than the soles and be enveloped by the sole material by being injected or cast around them.

The extraordinary flexibility of an athletic shoe with a sole as described by this invention is due, on the one hand, to the way in which it is shaped (undulating band) and, on the other hand, to the capacity of the undulating band to expand or stretch.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Athletic shoe sole with an insole and springy-elastic outer sole made of a plastic material, such as a polyamide, to which traction fittings in the form of at least one of studs, claws and spikes are attached and which is provided, in a ball area of the outer sole, with a flexible zone comprised of parallel ribs extending transversly across the outer sole, wherein said ribs are formed, on a ground contacting side of the outer sole, as well as on a side thereof directed toward the insole, as a continuous undulating band of wave crests and valleys which rise and fall relative to both said ground contacting side and the insole directed side thereof.

2. Athletic shoe according to claim 1, wherein the flexible zone is unitarily formed with the remainder of the outer sole of the same material thereas.

3. Athletic shoe according to claim 2, wherein, on the ground contacting side of the outer sole, at least some of the ribs extend over substantially the whole width of the outer sole.

4. Athletic shoe according to claim 1, wherein, on the ground contacting side of the outer sole, at least some of the ribs extend over substantially the whole width of the outer sole.

5. Athletic shoe according to claim 3, wherein, on the insole side of the sole, the ribs extend transversely across the outer sole to and terminate short of longitudinally extending side edge portions of the outer sole by an extent sufficient to provide a rib-free edge zone for attachment of the outer sole to a shoe upper.

6. Athletic shoe according to claim 5, wherein the undulating band of ribs appears in cross section as a line of waves with rounded-off crests on the ground contacting and insole sides of the outer sole.

7. Athletic shoe according to claim 1, wherein the undulating band of ribs appears in cross section as a line of waves with rounded-off crests on the ground contacting and insole sides of the outer sole.

8. Athletic shoe according to claim 1, wherein the undulating band of ribs appears in cross section as a double trapezoid line.

9. Athletic shoe according to claim 5, wherein the undulating band of ribs appears in cross section as a double trapezoid line.

10. Athletic shoe according to claim 5, wherein the undulating band of ribs appears in cross section as a saw-tooth line on both sides.

11. Athletic shoe according to claim 1, wherein the undulating band of ribs appears in cross section as a saw-tooth line on both sides.

12. Athletic shoe according to claim 1, wherein the undulating band of ribs appears in cross section as having V-shaped wave crests on the ground contacting side of the outer sole and trapezoidal wave crests on the insole side thereof.

13. Athletic shoe according to claim 5, wherein the undulating band of ribs appears in cross section as having V-shaped wave crests on the ground contacting side of the outer sole and trapezoidal wave crests on the insole side thereof.

14. Athletic shoe according to claim 5, wherein the undulating band of ribs appears in cross section to have a step-like meandering pattern.

15. Athletic shoe according to claim 1, wherein the undulating band of ribs appears in cross section to have a step-like meandering pattern.

16. Athletic shoe according to claim 1, wherein the undulating band of ribs is formed by one of casting and injecting of the sole material around small tubes arranged transverse to a longitudinal axis of the sole.

17. Athletic shoe according to claim 1, wherein a second flexible zone of said ribs is formed on both sides of the outer sole in a mid-foot joint area of the outer sole in a manner so as to leave a rib-free zone at longitudinally extending edges of both sides of the outer sole.

18. Athletic shoe according to claim 17, wherein said rib-free zone is approximately 10 mm wide.

19. Athletic shoe according to claim 17, wherein the ends of the ribs are rounded-off at least on the ground contacting side of the outer sole.

20. Athletic shoe according to claim 1, wherein said insole is provided with an intermediate piece made of a volume-compressible material which overlies the flexible zone.

21. Athletic shoe according to claim 17, wherein said insole is provided with intermediate pieces made of a volume-compressible material which respectively overly the flexible zones.

22. Athletic shoe according to claim 21, wherein the intermediate pieces of the insole are made of a volume-compressible material are formed of a porous or foamed rubber which, depending on the forces to which it is exposed, becomes elastic or compressible.

23. Athletic shoe according to claim 1, wherein the flexible zone is formed as a separate component that is integrally united into the outer sole.

24. Athletic shoe according to claim 23, wherein the flexible zone component is united to the outer sole by molding of said plastic material thereto.

25. Athletic shoe according to claim 1, wherein said traction fittings are attached to the outer sole in an easily replaceable manner.

* * * * *